United States Patent [19]

Springer

[11] Patent Number: 4,710,074

[45] Date of Patent: Dec. 1, 1987

[54] CASING MILL

[75] Inventor: Johann B. Springer, Aberdeen, Scotland

[73] Assignee: Smith International, Inc., Newport Beach, Calif.

[21] Appl. No.: 804,807

[22] Filed: Dec. 4, 1985

[51] Int. Cl.[4] ..... B23B 51/06; E21B 10/00

[52] U.S. Cl. ..... 408/200; 408/224; 175/325

[58] Field of Search ..... 408/200, 223, 224, 227, 408/229, 231, 199, 59, 203.5; 407/53, 54; 175/325; 166/242

[56] References Cited

U.S. PATENT DOCUMENTS

| | | | |
|---|---|---|---|
| 2,360,425 | 10/1944 | Kinzbach | 408/200 |
| 3,110,084 | 11/1963 | Kinzbach | 408/231 |
| 4,108,567 | 8/1978 | Faber | 408/224 |
| 4,189,266 | 2/1980 | Koslow | 408/224 |
| 4,564,321 | 1/1986 | Kondo et al. | 408/224 |
| 4,586,858 | 5/1986 | Kubota | 408/224 |

FOREIGN PATENT DOCUMENTS

| | | | |
|---|---|---|---|
| 2317568 | 10/1974 | Fed. Rep. of Germany | 408/224 |
| 180709 | 9/1985 | Japan | 407/43 |
| 61492 | 7/1912 | Switzerland | 408/227 |

OTHER PUBLICATIONS

Mechanical Engineers' Handbook, by Lionel S. Marks, 5th Ed. (1951), pp. 1758 to 1769.

Tool Engineers' Handbook, by the American Society of Tool Engineers', 2 Ed. (1959), pp. 21-3 to 21-10.

Metals Handbook, vol. 3, *Machining*, 8th Ed., American Society for Metals (1967), pp. 48 and 49.

*Primary Examiner*—Z. R. Bilinsky

*Assistant Examiner*—Daniel W. Howell

*Attorney, Agent, or Firm*—Christie, Parker & Hale

[57] ABSTRACT

A casing mill is set forth having a cylindrical body with one end adapted to be attached to a drill string and at the other end pilot vanes to guide the mill with respect to the casing. A plurality of blades project outwardly from the body to present a cutting edge for milling of the casing upon rotation of the mill. Polygonal tungsten carbide cutting elements are secured across a forward surface of each blade in a tesselating fashion, each element tilted in the direction of rotation of between 10–20 degrees. To mount the elements, the blade forward surface may include an inclined stairstep arrangement or inclined slots. Each element is brazed or bonded by a suitable organic adhesive to the forward surface.

16 Claims, 6 Drawing Figures

CASING MILL

FIELD OF THE INVENTION

This invention concerns apparatus for cutting pipe in an oil or gas well or the like.

BACKGROUND OF THE INVENTION

When oil and gas wells are drilled, steel pipe is commonly used as a casing in the bore hole. This casing may hang freely in portions of the bore hole, or may be cemented in place by pumping grout between the outside of the pipe and the bore hole. In subsea completions there is a pipe casing extending from the sea floor to the platform where drilling and production equipment is located.

In some situations it may be desirable to mill away a substantial length of casing in a well. This may be desired, for example, to remove cemented casing so that a well can be redrilled. It may also be desired to remove a section of casing to permit oil or gas production at a selected elevation in a well.

For this purpose, a casing mill is used. Casing mills are typically found in the form of an elongated body that can be connected to a drill string. Pilot guide means are provided at the downhole, i.e., terminal, end of the mill to axially position and guide the mill during the cutting of the casing. A plurality of cutting blades project radially from the housing to contact the casing for milling away a length of the casing when the mill is rotated. Drilling mud is pumped down the drill string to wash the steel chips up the annulus between the drill string and casing or bore. It has been conventional to employ fragments of cemented tungsten carbide for cutting along the forward surface of each blade. Each of the blades on the mill is in the form of a steel fin dressed or coated with a layer of brazing alloy matrix containing large particles of cemented tungsten carbide. Typically these may be made by crushing and screening scrap carbide. These particles are mixed with a brazing alloy and the mixture is then applied to the steel arm by melting in an oxyacetylene flame. This leaves particles of carbide more or less randomly distributed and oriented in the matrix.

Such random orientation of the carbide particles significantly limits the efficiency of cutting. The cutting edges on the particles are randomly distributed. The total quantity of carbide available for cutting is limited by the need to have a supporting matrix of brazing alloy. There is sometimes a problem of breakage of the carbide particles so that particles are lost or cutting edges are severely blunted. Further neither weight nor torque requirements are constant over the length of the mill and are different from mill to mill. Additionally, the shape and length of cuttings created by these prior mills vary to a great degree Long, thin and elastic cuttings tend to form bird's nests in the annulus around the drill string which can, in turn, increase the torque requirements to a point where the drill string cannot be rotated or where the circulation of mud is impeded.

SUMMARY OF THE INVENTION

There is, therefore, provided in the practice of the present invention a casing mill having a cylindrical body attached at one end to a drill string and having at or near the other end means for piloting the body coaxially into and along the casing. Between the ends a plurality of blades are attached as by welding to project from the body each mounting a plurality of polygonal, tungsten carbide elements adapted to cut away the casing when the mill is rotated. Each of the elements may be rectangular, square, rhomboid, triangular or the like having a smooth front face and a back face secured by brazing or by the application of a suitable organic adhesive to the front surface, i.e, the surface facing in the direction of rotation, of the blade. The front face of each element is preferably oriented with a negative back rake for efficiently cutting steel in this environment. In other words, it is preferable to mount the elements so that the front face is in a plane that is not parallel to the casing mill axis. For this purpose, the forward surface of each blade may be fashioned to have a plurality of steps or slots, each step or slot maintaining one or several elements in a tesselating fashion over a rectangular area at the desired rake angle. Rotation of the drill string and mill results in the baldes cutting away the casing, the cutting chips and debris being carried away by mud pumped down through the drill string and mill.

By providing the elements which cover a retangular area, constant milling rates can be achieved. The weight of the steel that can be removed determines the number of blades that are attached to the body. Further, by advancing the mill at a selected rate or rates, short cuttings are created which do not inhibit rotation of the mill and which can be easily carried away by the mud.

BRIEF DESCRIPTION OF THE DRAWINGS

These and other features and advantages of the present invention will become better understood with reference to the specification, claims and drawings wherein:

DETAILED DESCRIPTION

Figure 1:
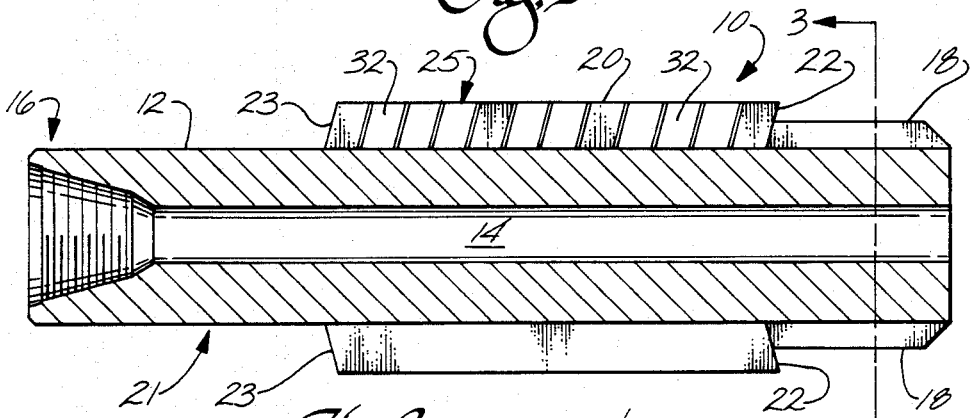
FIG. 1 is a section view of one embodiment of a casing mill according to the present invention taken along line 1—1 of FIG. 3.
Figure 3:
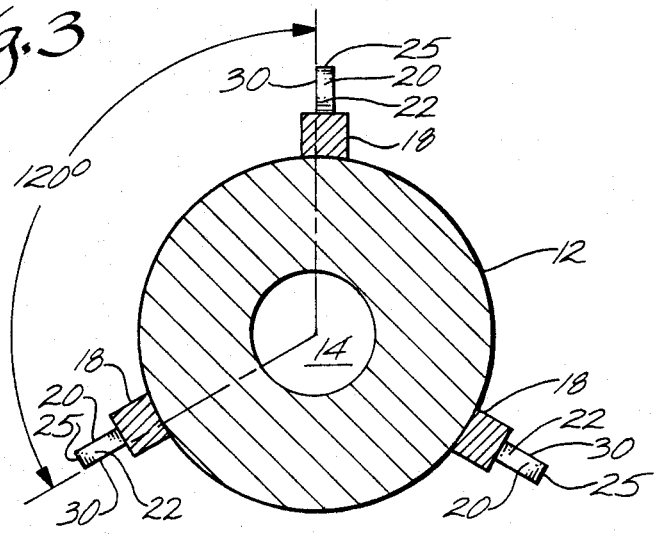
FIG. 3 is an enlarged section view of FIG. 1 taken along line 3—3.

To remove a length of casing in a well for whatever purpose, a casing mill 10 as shown in FIGS. 1 and 3 is provided. The mill 10 has a cylindrical body 12 adapted to be inserted into the casing and having an axial through bore 14 to pass mud which is circulated through the mill 10 and up the casing and well bore to carry away the cuttings. The mill 10 is secured to the end of a drill string and accordingly one end of the body 12 is provided with a threaded bore defining a box and 16 which receives a pin end (not shown) of the drill string to couple the mill 10 thereto in a well known fashion.

The mill 10 is inserted into the casing and for this purpose means are provided for piloting the mill 10 coaxially into and along the casing. As shown in FIG. 1, the pilot means include a plurality of vanes 18 disposed at the end of the mill 10 opposite the box end 16, each of the vanes 18 projecting radially from the body 12 to engage the inside surface of the casing. Accordingly, the vanes 18 of which there are preferably three, are closely received into the casing and coaxially align the mill 10 therewith. The end of the mill 10 opposite the box end 16 may be dressed with crushed tungsten carbide (not shown) to clean out the casing. A connection (also not shown) can be machined at the end of mill 10 opposite the box end 16 so that another mill or other drilling equipment can be attached to the mill 10 in tandem. Between the blades 20 and box end 16 a fishing neck 21 for the mill is defined.

The drill string and mill 10 are rotated in typically a right hand direction and are axially loaded to turn or mill away the casing. The chips and debris removed by the mill 10 are carried by the drilling mud upwardly along the annulus between the drill string and casing or well bore to the surface. To provide for the aforesaid cutting action, the mill 10 includes a plurality of blades 20 arranged as shown in FIGS. 1 and 3, each of the blades 20, as described below, including a plurality of hard, cutting elements. The blades 20 are evenly spaced about and are disposed along the body 12 between the box end 16 and the pilot vanes 18. Each blade 20 projects outwardly from the body 12 to engage and, as described above, remove or mill away the casing as desired. The blades 20 may be welded or bolted to the body 12. By providing bodies of different diameters, identical blades may be used to mill more than one size of casing.

Figure 2:
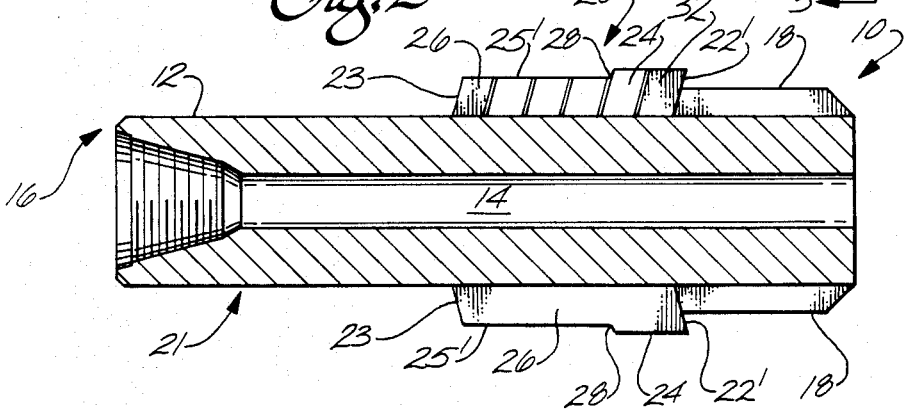
FIG. 2 is a section view similar to that of FIG. 1 of another embodiment of a casing mill according to the present invention.

With particular reference to FIG. 1, the mill 10 depicted therein is adapted for removing a length of casing whereas the mill 10 of FIG. 2 is adapted to remove a casing joint and thereafter a length of the smaller diameter casing. The casing is embodied as a length of pipe having a known outside diameter and wall thickness. The piloting vanes 18 are adapted to be closely received into the inside diameter of the casing to coaxially position and guide the mill 10 as discussed above. To mill the casing, each blade 20 projects outwardly from the body 12 a distance greater than the vanes to present a cutting edge 22 which, as shown, may be inwardly inclined, for example, at an angle of 15 degrees with respect to a radial plane. Opposite the cutting edge 22 each blade 20 has an upper edge 23 representing the up-hole end of the blade 22. Each blade 20 has a terminal edge 25 which is remote from the body 12 and defines, in cooperation with the other blades the radially outermost periphery for the mill 10 which is somewhat greater than the outside diameter of the casing so as to define the cutting edges 22 of the proper radial dimension to mill the casing. Each of the blades 20 has an axial length between the cutting edge 22 and upper edge 23 sufficient to mill the desired length or lengths of casing. Hence, each blade 20 may be presented as an elongated parallelogram.

Figure 4:
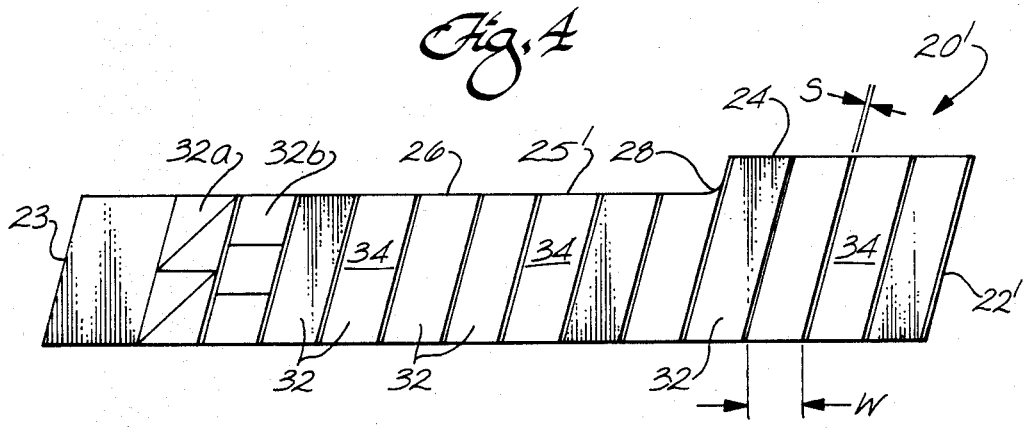
FIG. 4 is a side view of a cutting blade for the device as shown in FIG. 2.

With reference to FIGS. 2 and 3, the mill 10 is shown adapted to remove a casing joint and thereafter a length of casing. The joint between lengths of casings has a greater outside diameter and hence the blades shown as 20' must be adapted to engage and mill away the larger diameter joint. Accordingly, the mill blades 20, each have a cutting edge 22' which projects a radial distance sufficient to engage and mill the larger diameter joint. The cutting edge 22' may be inclined as is cutting edge 22. Hence, in comparison to the edge 22 of the mill of FIG. 1, edge 22' projects a greater radial extent. To provide sufficient cuting material to mill the joint, the blade 20' extends outwardly from the body 12 a radial distance defined by the cutting edge 22' and axially upwardly (to the left in FIG. 2) a length sufficient to mill the joint and create a first portion 24 for the blade 20'. From the first portion 24, the blade 20' extends axially (longitudinally) to terminate at the upper edge 23 defining a second portion 26. The second portion 26 is adapted, after the first portion 24 has milled the joint and has worn away, to mill the smaller diameter casing. Hence, the second portion 26 extends a lesser radial distance from the body 12 than does the first portion 24. The axial length of the second portion 26 may be as desired dependent upon the length of casing to be milled. As can be appreciated, the differing radial extents of the first and second portions 24 and 26 produce a stepped terminal edge 25' for the mill 10. As shown in FIG. 4, the first portion 24 and second portion 26 are joined at the terminal edge 25' of the blade 20' by a round 28 to prevent concentration of stresses from fracturing the blade.

As can be appreciated, the blades can have any desired length or shape as determined by the diameter and length of the casing element to be milled.

As stated above, the mill is adapted to be rotated and axially loaded to cut away the casing. For this purpose, each blade 20 presents a forward surface 30 which faces in the direction of rotation. Usually, the mill is rotated in a right hand direction. Hence, as shown in FIG. 3, each of the blades 20 has a forward surface 30. In that the mill 10 has three blades 20, each of the forward surfaces 30 is offset 120 degrees from the adjoining blade forward surface 30 and each of the forward surfaces 30 is arranged along a radial plane. Of course, the number of blades can be altered as well as their circumferential spacing.

Figure 5:
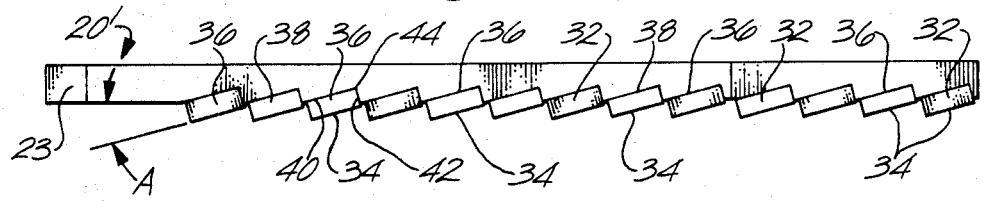
FIG. 5 is a section of the blade of FIG. 4 taken along line 5—5.
Figure 6:
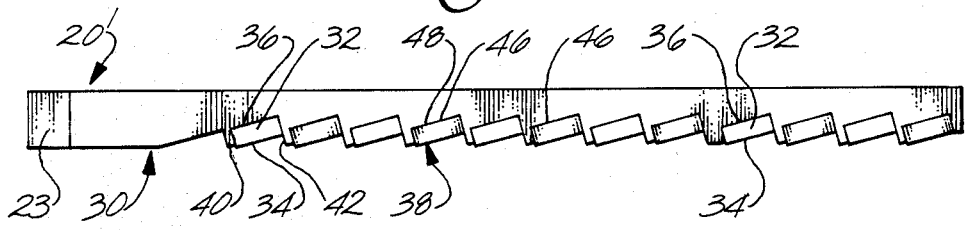
FIG. 6 is a view similar to that of FIG. 5 showing yet another embodiment of the cutting blade.

To provide for the milling of the steel casing and if required a joint, each blade forward surface 30 has attached thereto a plurality of tungsten carbide cutting elements 32. With reference to FIGS. 4–6, each of these elements 32 is fashioned as a polygonal slab and hence presents a plane section which may be a rectangle, square, rhombus, triangle or the like. A smooth front face 34 is defined on each element 32 as is an opposite back face 36 which is brazed or bonded by an appropriate organic adhesive to the blade forward surface 30. Vulcanizing the elements to the forward face 30 by using 0.020–0.070 inches of a rubber or other suitable material interposed between the element 32 and forward face 30 is one technique contemplated to bond the elements to the blades. This material also provides a cushion for the elements 32. The back surface 36 may be rough to provide for a better bond between the element 32 and the forward surface 30. Each element or element set may have a width W of about 0.640 inches a thickness of about 0.25 inches and may be spaced from adjacent elements a distance of about 0.040 inches.

With reference to FIGS. 4–6, the arrangement of the elements 32 on a blade 20' is shown. It should be understood that the arrangement of the elements for a blade of the type shown in FIG. 1 would be substantially similar.

The elements 32 are arranged in a substantially tessellating or mosaic fashion over the forward surface 30 of the blade 20'. As shown, each of the elements 32 may be embodied as a parallelogram extending over the radial length of the forward surface 30 as shown at the right side portion of FIG. 4 or, as shown at the left hand end of FIG. 4, may be arranged as triangular elements **32*a* or rhomboid elements 32*b*** arranged in a substantially abutting relationship in a radial direction along the radial length of the blade 20'. Suffice it to say the elements 32, 32*a* or 32*b* present a substantially continuous facing of tungsten carbide for the forward surface 30. A portion of the upper extent of each blade is left bare to provide a positive indication of wear.

To provide for efficient cutting of the casing, it is preferred that each of the elements front faces 34 be arranged at a back rake angle A with respect to an axial plane emanating from the axis of the mill 10 so as to tilt the upper edge of each element toward the direction of mill rotation. It has been found that a rake angle A of about between 10–20 degrees and preferably 15 degrees provides for satisfactory operation of the mill 10. That is, torque requirements are reduced and the desired short cuttings of removed casing are produced. To arrange the elements 30 and more particularly their front faces 34 at the aforesaid back rake angle A, the forward surface 30, as shown in FIG. 5 may be provided with a plurality of inclined steps 38. Each step 38 includes a tread 40 arranged at the aforesaid rake angle A with respect to an axial plane, having a width to accommodate the elements 32. The tread 40 terminates at a riser 42 which cooperates with the tread 40 to define a perpendicular seat 44 for the element or set of elements 32.

Accordingly, the elements 32 are positined at the seat 44 such that the back face 36 rests on the tread 40 and the element 32 abuts the riser 42. Thereafter, the elements are suitably brazed or bonded to the blade 20.

With reference to FIG. 6, an alternative embodiment of a blade is shown. According to this embodiment, each of the aforesaid steps 38 is provided with a slot 46 to closely accommodate the element or elements 32. Each slot 46 has a bottom 48 arranged parallel to the tread 40 and hence arranged at the desired rake angle A to seat the element or elements 32 such that the front faces 34 are likewise disposed at the desired back rake angle A. The slots 46 may have a depth such that the element front faces 34 are disposed flushed with the tread 40 of the front face steps 38. To accommodate the slots, the blade according to this embodiments is made somewhat thicker.

The blades and their cutting elements are disposed on the mill body 12 by whatever technique and the mill 10 is lowered at the end of the drill string into the well bore. Rotating the drill string and mill 10 the blades 20, and more particularly their cutting edges 22, are brought into contact with the casing to be milled away. Axially loading the mill 10 and pumping mud down the drill string results in the blades milling away the casing. The element 32 disposed at the cutting edge 22 first acts to cut away the casing. As this element wears away or fails, the superposed elements, in succession, define a new cutting edge for the mill 10. When the blades are exhausted, the mill 10 is recovered and new blades are attached.

It is believed that the milling rates obtained by the mill 10 are limited only by the amount of cuttings that can be handled by the surface mud system. For example, at a cutting speed of about 100 feet per minute, a cutting thickness of about 0.020 inches and a casing wall thickness of 0.6 inches, that over 245 pounds of casing can be milled.

While I have shown and described certain embodiments of the present invention, it is to be understood that it is subject to many modifications without departing from the spirit and scope of the invention recited in the appended claims.

What is claimed is:

1. In a casing mill of the type having a cylindrical body to be received into a well bore casing and having means at one end to attach the mill to a drill string for rotation therewith and means at the other end for piloting the mill in the casing, the improvement comprising:

a plurality of blades projecting outwardly from the body, each blade having a forward surface including a stair-step configuration having treads arranged at an angle between 10 and 20 degrees with respect to an axial plane, and orthogonal risers;

a plurality of polygonal cutting elements secured in a tesselating arrangement on each of said blade forward surfaces each of said elements having a back face secured to the treads on the forward surface and a front face to engage and mill the casing, so that said front faces are arranged to tilt in the direction of mill rotation to make, with respect to an axial plane, an angle of between 10 and 20 degrees.

2. The mill of claim 1 wherein each of said cutting elements front face is a parallelogram.

3. The mill of claim 2 wherein each of said elements front face is rectangular.

4. The mill of claim 2 wherein each of said elements front face is square.

5. The mill of claim 2 wherein each of said elements front face is rhomboid.

6. The mill of claim 1 wherein each of said elements front face is triangular.

7. The mill of claim 1 wherein each tread includes a slot to receive one or more elements, said elements secured in said slots with their front faces arranged at said angle.

8. The mill of claim 1 wherein the elements are secured to the blade forward surfaces by a brazed connection.

9. The mill of claim 1 wherein each of the elements is secured to the blade forward surfaces by an organic adhesive.

10. The mill of claim 9 wherein the adhesive is a vulcanized rubber compound.

11. The mill of claim 1 wherein each blade includes a first portion projecting a first radial distance from the body to define a cutting edge for milling a casing joint, the blade also having a second portion extending from the first portion and projecting a lesser, second radial distance from the body for milling casing components having a diameter less than said joint, said elements secured over the forward face of the blade first and second portions.

12. A casing mill comprising:

a cylindrical body having one end adapted to be connected to a drill string for rotation therewith and means for piloting the body into coaxial alignment with a casing;

a plurality of blades projecting outwardly from the body for engagement with the casing, each blade having a forward surface facing in the direction of mill rotation having fashioned thereon a stair-step configuration including radially extending treads inclined at said angle and orthogonal risers; and a plurality of polygonal tungsten carbide cutting elements secured in a tesselating arrangement on the treads of each of forward surface, each of said elements having a planar front face to engage and mill the casing, each of said elements arranged to tilt in the direction of rotation an angle of between 10 and 20 degrees with respect to an axial plane.

13. The mill of claim 12 wherein each tread includes a perpendicular slot to receive one or more of said elements.

14. The mill of claim 13 wherein each of said elements front faces is substantially flush with the said tread.

15. The mill of claim 12 wherein said elements are secured to the blade forward surfaces by a layer of organic adhesive.

16. The mill of claim 15 wherein the adhesive is a vulcanized rubber material.

* * * * *

UNITED STATES PATENT AND TRADEMARK OFFICE

CERTIFICATE OF CORRECTION

PATENT NO. : 4,710,074

DATED : December 1, 1987

INVENTOR(S) : Johann B. Springer

It is certified that error appears in the above-identified patent and that said Letters Patent is hereby corrected as shown below:

Column 2, line 18, for "baldes" read -- blades --;

Column 3, line 67, for "cuting" read -- cutting --;

Column 5, line 12, before "rake" read -- back --.

Signed and Sealed this

Twelfth Day of July, 1988

*Attest:*

*Attesting Officer*

DONALD J. QUIGG

*Commissioner of Patents and Trademarks*